US011385008B2

(12) United States Patent
Markut

(10) Patent No.: US 11,385,008 B2
(45) Date of Patent: Jul. 12, 2022

(54) BOLT CATCH FOR A FIREARM

(71) Applicant: GLOCK TECHNOLOGY GMBH, Ferlach (AT)

(72) Inventor: Karl Markut, Klagenfurt (AT)

(73) Assignee: Glock Technology GmbH, Ferlach (AT)

( * ) Notice: Subject to any disclaimer, the term of this patent is extended or adjusted under 35 U.S.C. 154(b) by 36 days.

(21) Appl. No.: 17/116,110

(22) Filed: Dec. 9, 2020

(65) Prior Publication Data

US 2021/0180900 A1 Jun. 17, 2021

(30) Foreign Application Priority Data

Dec. 13, 2019 (EP) ..... 19215965

(51) Int. Cl.

| | |
|---|---|
| ***F41A 17/36*** | (2006.01) |
| ***F41A 3/66*** | (2006.01) |
| ***F41A 3/72*** | (2006.01) |
| ***F41A 35/06*** | (2006.01) |

(52) U.S. Cl.

CPC ..... *F41A 17/36* (2013.01); *F41A 3/66* (2013.01); *F41A 3/72* (2013.01); *F41A 35/06* (2013.01)

(58) Field of Classification Search

CPC .. F41A 3/68; F41A 17/36; F41A 17/40; F41A 17/42; F41A 35/06

See application file for complete search history.

(56) References Cited

U.S. PATENT DOCUMENTS

| | | | | |
|---|---|---|---|---|
| 4,681,020 | A | 7/1987 | Polanecky | |
| 7,661,219 | B1 * | 2/2010 | Knight, Jr. | F41A 3/42 89/138 |
| 8,261,652 | B2 | 9/2012 | Findlay | |
| 9,651,328 | B1 * | 5/2017 | Oglesby | F41A 35/06 |
| 9,810,493 | B2 | 11/2017 | Fluhr | |
| 9,958,223 | B1 | 5/2018 | McGinty | |
| 10,197,353 | B2 | 2/2019 | Lewis | |
| 2004/0035286 | A1 | 2/2004 | Spinner | |
| 2014/0033824 | A1 | 11/2014 | Vigne | |
| 2015/0032327 | A1 | 11/2015 | McGinty | |
| 2018/0014943 | A1 | 5/2018 | Headrick | |
| 2020/0278164 | A1 * | 9/2020 | Denson, III | F41A 17/36 |

FOREIGN PATENT DOCUMENTS

DE 10008979 A1 9/2001

OTHER PUBLICATIONS

EP Search Report, established May 20, 2020 in EP application No. 19215965.

* cited by examiner

*Primary Examiner* — J. Woodrow Eldred

(74) *Attorney, Agent, or Firm* — Raven Patents, LLC; Anton E. Skaugset

(57) ABSTRACT

Bolt catches for firearms, receivers for firearms configured to receive the bolt catches, and firearms including the disclosed receivers and bolt catches. The disclosed bolt catches have a first bolt catch lever having a center element defining an undercut recess configured to optionally receive a connection section of a second bolt catch lever, and a biasing element configured to urge the first bolt catch lever into an idle position; the disclosed receivers are configured to receive the disclosed bolt catches, and the disclosed firearms include a receiver, and a grip and/or a stock, provided that the receiver defines a recess for receiving a second bolt catch lever and/or a plug.

20 Claims, 7 Drawing Sheets

Fig. 8A
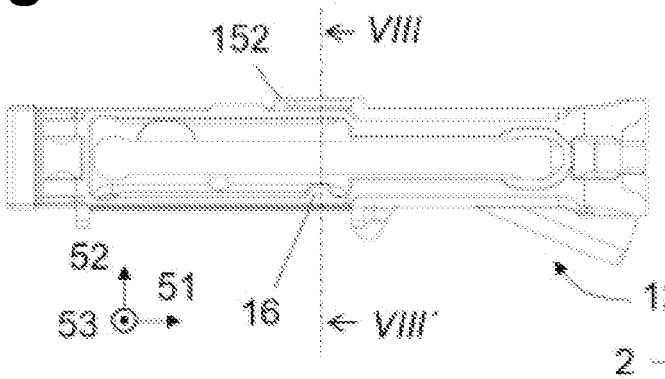
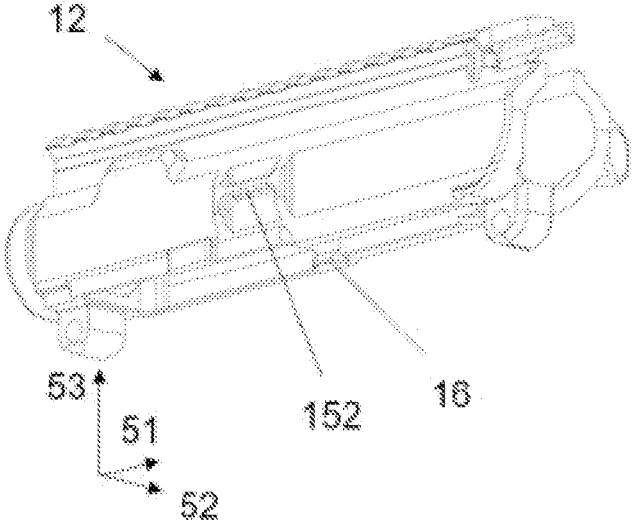
Fig. 8C
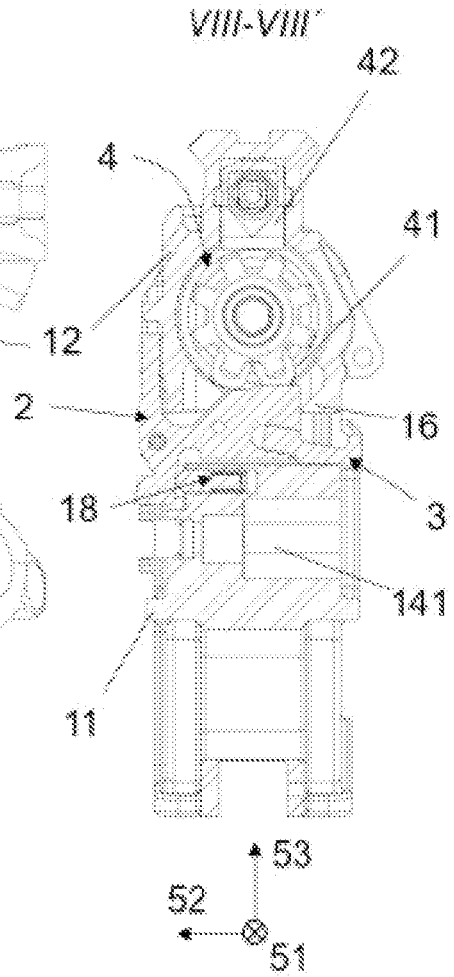
Fig. 8B

BOLT CATCH FOR A FIREARM

TECHNICAL FIELD

The present disclosure relates to firearms. More particularly, the disclosure relates to bolt catches that can be operated on one side of the firearm, and that can be adapted for ambidextrous use.

BACKGROUND

Bolt catches are widely used in multi-shot firearms, and in particular in automatic firearms. For most such, firing the weapon results in the bolt carrier being driven rearwards. Under the influence of the recoil spring, the bolt carrier is urged forwards by the recoil spring, loading a new cartridge in the chamber and locking the rotatable bolt head in place by means of locking lugs or locking directly in the barrel. The bolt carrier can also be pulled rearwards by manually actuating a cocking slide during manual loading.

After the last cartridge in the magazine is discharged, the bolt does not automatically return to its forward position, but is instead automatically caught by an interaction between the magazine follower and a spring-preloaded bolt catch. Following a magazine change, the actuating element of the bolt catch, which is usually arranged on the left-hand side of the receiver, can be manually actuated by the shooter, releasing the bolt carrier and placing the weapon into condition to fire.

It may also be useful or necessary for a shooter to use the bolt catch to manually prevent the advancing of the bolt, whether or not the magazine is empty. This may e.g. be the case when disassembling the weapon, or if it is necessary to manually interrupt an automatic firing process.

As used herein, and as described in simplified terms, the bolt is understood to mean a slide or bolt carrier which receives at least one bolt head. The bolt catch of a firearm primarily serves to catch the bolt and keep it open in a defined position after the last cartridge in a magazine is fired. In this process, the bolt catch is typically actuated via the interaction of a bolt catch projection or bolt catch finger with a defined edge, protrusion or the like on a magazine follower. This edge or protrusion of the magazine follower typically projects from the top of the empty magazine after firing the last cartridge.

Bolt catches that can be actuated ambidextrously have been previously developed, as they can provide an opportunity for easy operation by both right- and left-handed shooters. See, for example, U.S. Pat. Nos. 10,197,353 B2, 9,958,223 B1, 8,261,652 B2, and 9,810,493 B2, each of which is incorporated by reference for all purposes.

The right-sided actuation of the bolt catch described in U.S. Pat. No. 10,197,353 B2 (hereby incorporated by reference) is carried out by a right-sided actuation element, which translates the movement to the left-hand actuating element by means of a lever and a cam. For receiving the right-hand actuating element, a recess, guide, and mount on the upper receiver specifically intended for this purpose is required, and as a result there generally is not the option to retrofit this bolt catch in existing AR15 rifles.

A similar approach is taken in U.S. Pat. No. 8,261,652 B2 (hereby incorporated by reference), where the right-sided actuation of the bolt catch is deflected via a fork-shaped receptacle for a protrusion of the left-hand lever. This design however requires a receiver configured to incorporate the particular bolt catch, in order for it to receive the bolt catch in the corresponding recesses.

U.S. Pat. No. 9,958,223 B1 (hereby incorporated by reference) also describes a bolt catch lever that can be operated ambidextrously. The lever, which is disposed on the left side from the shooter's point of view, includes a recess in its center element designed to interact in the manner of a toggle mechanism with a protrusion of a right-side lever. However, two spring mechanisms and two separate lever axes are required, and this makes it difficult to retrofit an existing AR rifle and/or requires a lower receiver that is designed for this purpose.

U.S. Pat. No. 9,810,493 B2 (hereby incorporated by reference) discloses a bolt catch lever that is suitable for ambidextrous operation, including two actuating levers that are integrally formed, meaning that the entire bolt catch lever is formed in one piece. The right-sided and left-sided actuation can be carried out about one common tilting axis. The use of such a bolt catch lever requires some minor adaptations to the receiver.

Examples for ambidextrous bolt catches stops may be found in US Patent application publication nos. 2014/0338243 A1, 2018/0149438 A1, US 2015/0323271 A1, 2004/035286 A1, and U.S. Pat. No. 4,681,020 (each of which is hereby incorporated by reference for all purposes). Each of these disclosures describe bolt catches that are ambidextrous and include a plurality of components. Nevertheless, none of these disclosed catches can be changed into a one-sided bolt catch mechanism.

A range of multiple-part bolt catch arrangements are well-known to those of skill in the art, all requiring varying levels of adaptation to the lower receiver of an AR-type rifle in order to make ambidextrous operation possible. Specifically, it is often difficult to retrofit existing rifles with an ambidextrous bolt catch. One-piece bolt catches that can be operated ambidextrously are also known to skilled artisans, but they likewise require some minor adaptations to the lower receiver in order to retrofit an existing weapon for ambidextrous operation of the bolt catch.

In some cases, however, an ambidextrous bolt catch must be provided, such as for weapons exercises, training, and the like, and the bolt catch has to be adapted to the shooter's needs. In a specific case, this may also mean that the shooter wants to dispense with right-sided operation of the bolt catch after they have used an ambidextrous bolt catch for training purposes. With previously disclosed bolt catches, such adaptation is extremely time-consuming and, in some cases even impossible without the correct tool, due to the arrangement of the bolt catch lever. Adapting such bolt catches may not even be possible when operating in the field. In addition, the receivers of rifles that are designed specifically for bolt catches that can be operated ambidextrously typically include an aperture on at least on one side of the receiver even if the rifle has been reverted to a conventional one-sided bolt catch. Such an aperture in the receiver is generally undesirable, since it may permit foreign bodies, such as sand, dust, and water, to penetrate the receiver.

What is needed, therefore, is a bolt catch that is simple to produce, simple to operate, which allows for ambidextrous operation and, if necessary, can be easily reverted to a single-sided bolt catch. Another problem addressed by the invention is that the bolt catch can be implemented in existing AR-15 receivers with as little complexity as possible. Furthermore, the problem consists in making it difficult for undesired foreign bodies to penetrate into the receiver.

SUMMARY

The present disclosure is directed to bolt catches for firearms, receivers for firearms that can receive the disclosed bolt catches, and firearms including such a receiver and/or bolt catch. The disclosure further provides apparatus for reducing the penetration of foreign bodies.

In one example, the present disclosure includes a bolt catch for a firearm, including a first bolt catch lever having a center element defining an undercut recess configured to optionally receive a connection section of a second bolt catch lever, and a biasing element configured to urge the first bolt catch lever into an idle position.

In another example, the present disclosure includes a receiver for a firearm, including a lower receiver configured to receive a bolt catch that in turn includes a first bolt catch lever having a center element defining an undercut recess configured to optionally receive a connection section of a second bolt catch lever, and a biasing element configured to urge the first bolt catch lever into an idle position, where the lower receiver defines a bolt catch receptacle that is continuous in the transverse direction.

In yet another example, the present disclosure includes a firearm including a receiver, and a grip and/or a stock, provided that the receiver defines a recess for receiving a second bolt catch lever and/or a plug.

The disclosed features, functions, and advantages of the disclosed bolt catches, receivers and firearms may be achieved independently in various embodiments of the present disclosure, or may be combined in yet other embodiments, further details of which can be seen with reference to the following description and drawings.

Figures 7A, 7B, 7C:
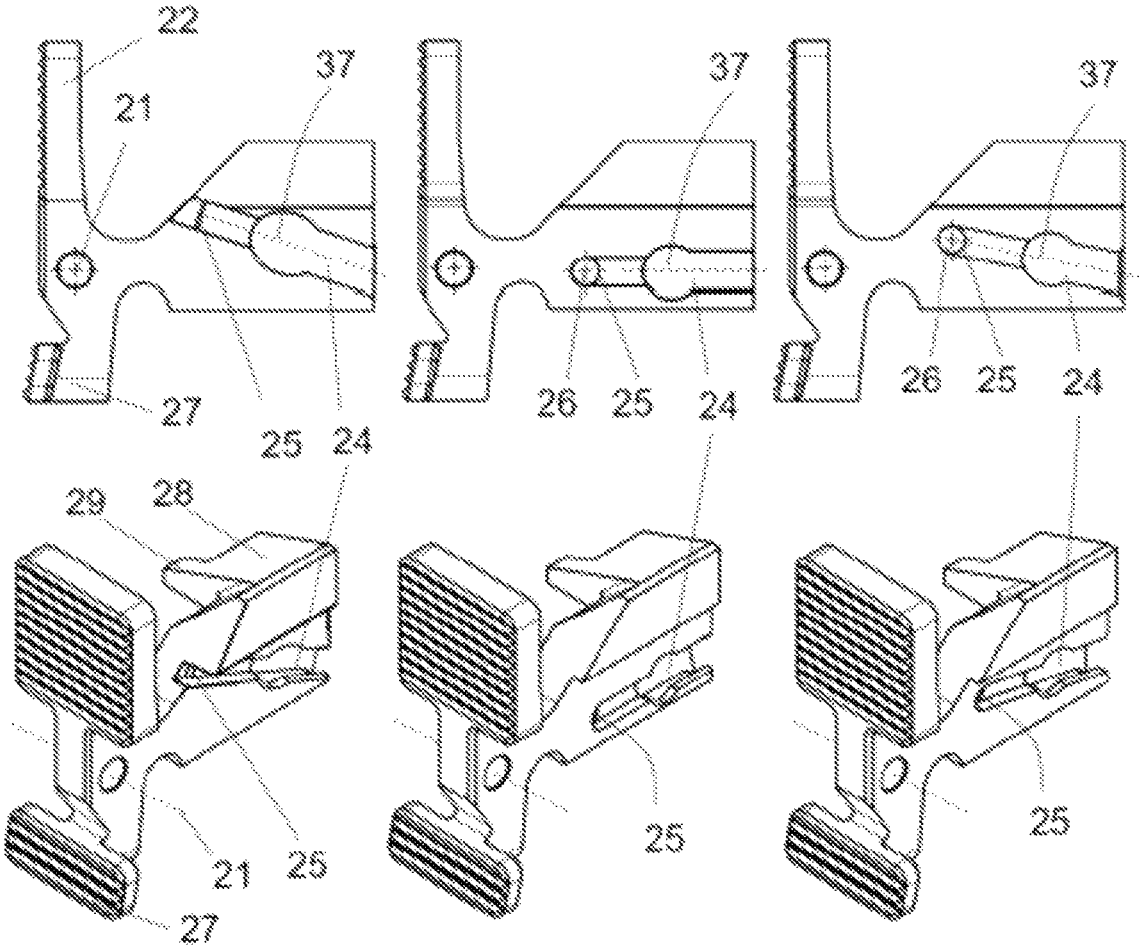

Each of FIGS. 7A-7C depict an additional exemplary embodiment of an illustrative bolt catch lever in a "rear" elevation (above) and in an associated oblique "rear" view (below).

FIG. 8A is a bottom view of an upper receiver; FIG. 8B is a cross section of the upper receiver along line VIII-VIII' shown in FIG. 8A; and FIG. 8C is an oblique view from "below" the upper receiver.

Figure 9:
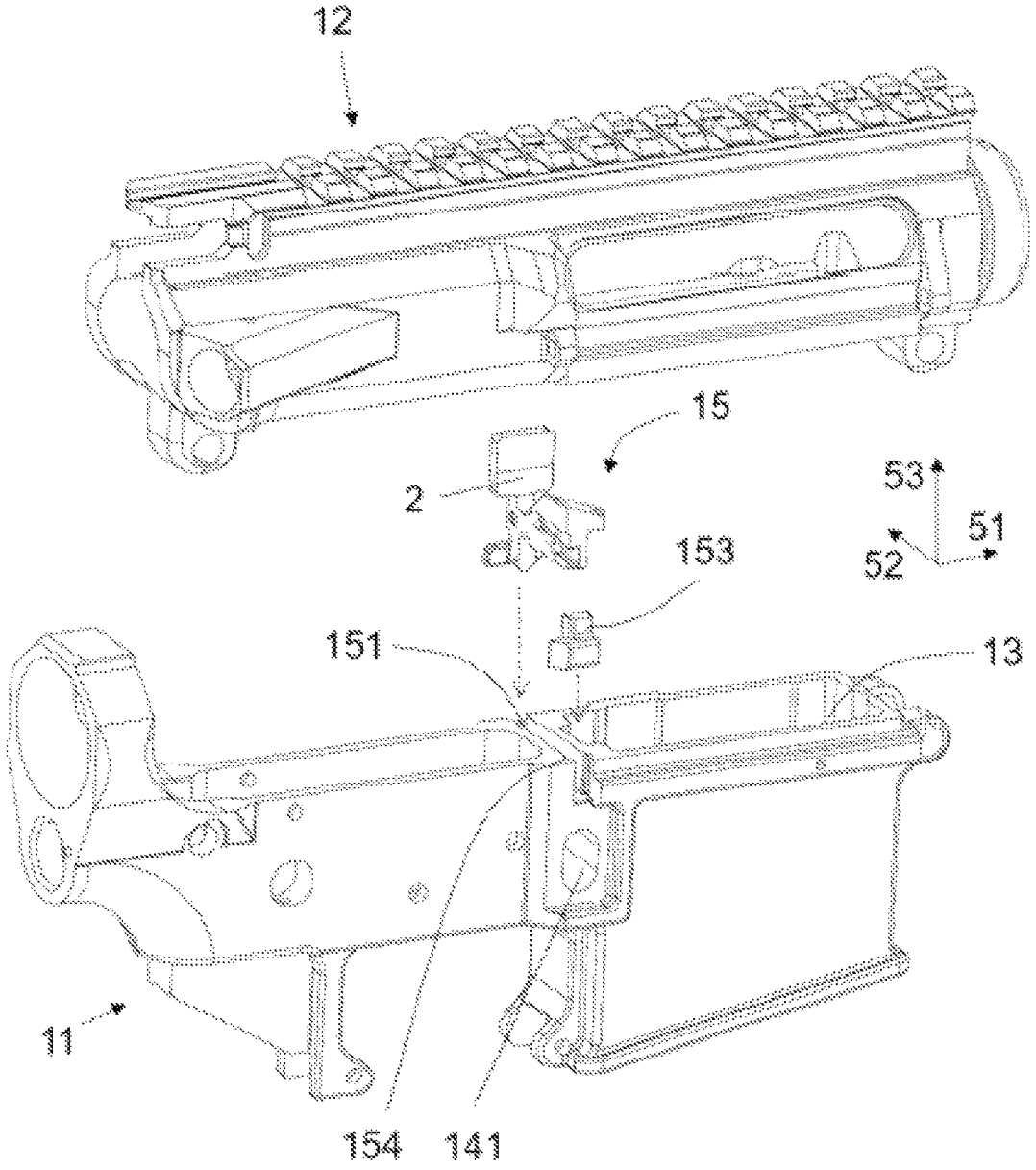

FIG. 9 is a perspective and exploded view of a lower receiver having an illustrative bolt catch and plug shown thereabove, and of an upper receiver.

DETAILED DESCRIPTION

The bolt catches, receivers, and firearms disclosed herein may be exemplified in the context of an M4-, M16-, or AR15-type rifle, and they may in fact exhibit particularly advantageous properties when used with these weapons. For example, a bolt catch that is suitable for arrangement in a rifle such as an AR-15 type rifle is denoted by reference number "15." It should be appreciated, however, that the teaching of the present disclosure is not limited to such rifles, or even limited to long guns, but in principle can also be applied to pistols.

The present disclosure may illustrate a firearm bolt or bolt carrier in simplified terms, and with reference to the arrangement and characteristics of an exemplary bolt carrier having a bolt head received therein such as may be compatible with an M4-, M16-, or AR15-type rifle. The loading processes and bolt mechanisms of such rifles are well known to a person skilled in the art, and so such procedures will be referred to only briefly in the disclosure. The present disclosure is also directed to a receiver for receiving the illustrated bolt catch, and to methods for reducing the penetration of foreign bodies into the receiver.

In the description and claims, the terms "forward", "rearward", "top", "bottom" and so on are used in the common form and with reference to the object in its normal position of use. This means that, in the case of a firearm, the muzzle of the barrel is "forward", and the bolt or bolt carrier is moved "backwards" under the effect of the gases after a shot is discharged and moves "forwards" again under the effect of a recoil spring, etc. "Lower" and "downwards" are used to mean the direction in which the magazine extends away from the bolt, and "upper" and "upwards" are used to mean the direction away from the magazine. The terms "central weapon plane," "bore," "barrel axis," etc., have the normal meaning that a person skilled in the art would attribute to them in the prior art. "Left" is thus based on the central weapon plane, "from the left" corresponds to a movement, actuation, exertion of force towards the central weapon plane from a starting position to the "left" thereof, etc.

The bolt catch levers of the present disclosure, or first bolt catch levers, include a center element for optionally receiving a second bolt catch lever. This recess, or receptacle, extends laterally and inwards in the transverse direction, i.e. substantially towards the pivot axis, in the center element. The recess is designed as an undercut.

A first bolt catch lever designed in this way creates the possibility of temporarily attaching a second and optional bolt catch lever, which can be easily inserted into the recess of the first bolt catch lever. Owing to the presence of the undercut, the second bolt catch lever can be received by the first bolt catch lever in part and can be received such that the connection section to be inserted, when viewed in the barrel direction, does not project beyond the original dimensions of the center element of the first bolt catch lever. This makes it possible to easily insert the first bolt catch lever into an existing receiver of an AR-15 type rifle. If the second bolt catch lever is to be mounted, just one hole for the bolt catch receptacle of an existing receiver is required on the "right-sided" receiver wall, when viewed by the shooter. Such a bolt catch receptacle, which is continuous in the transverse direction, can be made relatively easily using a machine, e.g. by milling or broaching, or in the worst case can even be made using a file. Ideally, a receiver formed according to the invention is provided, as described below.

As a result, the user may easily change the ambidextrous bolt catch lever configuration into a one-sided configuration, such as a "right-hand" version and vice versa.

The present disclosure additionally provides additional aspects of the disclosed bolt catch that provide options for attaching the second, optional bolt catch lever in an optimal position for the shooter and/or provide the option of mounting said lever such that it is secured against loss as far as possible.

Some other aspects of the disclosed bolt catch lever may relate to possible adaptations to the upper and/or lower receiver of a firearm, and to the use of an optional plug in order to protect the disclosed bolt catch by minimizing the undesired penetration of foreign bodies, in particular sand, dirt, and dust, into the receiver. These aspects relate, inter alia, to a receiver for receiving the bolt catch, a grip, a receiver, or a stock comprising a recess for the temporary safekeeping of the non-required second bolt catch lever and/or plug. In summary, these aspects should be understood to be various aspects of a system and mechanism for reducing the penetration of foreign bodies into the receiver.

As illustrated in the accompanying drawings, it has been attempted to denote everything relating to the receiver 1 by a reference numeral "1 n," with reference number "2n" being used for the first bolt catch lever according to the invention, "3n" being used for second bolt catch lever, "4n" being used for the bolt carrier, and "5n" being used for the receiver-based coordinate system for orientation (see the Listing of Reference Numerals, below).

Figure 1:
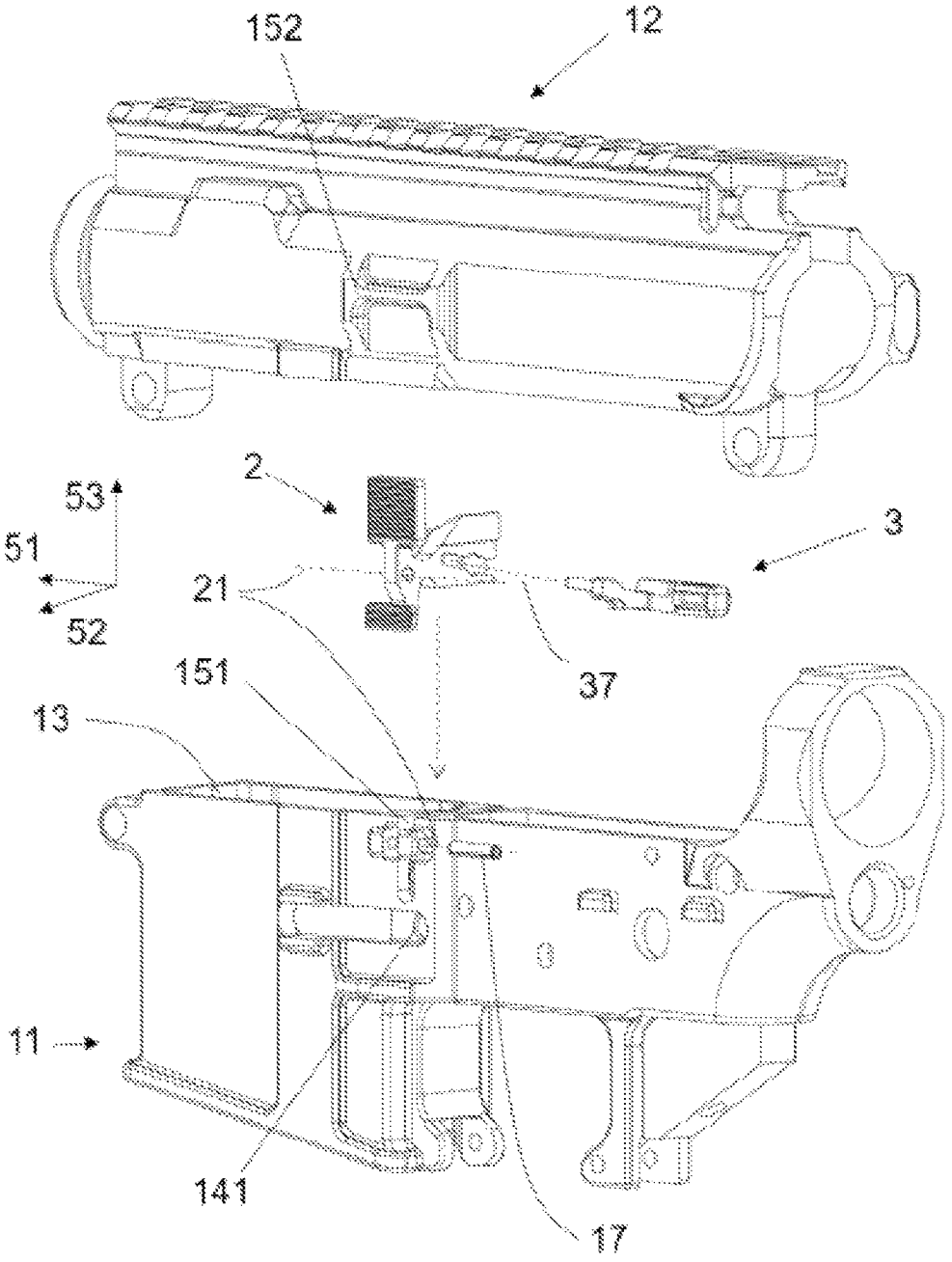
FIG. 1 is a perspective exploded view of a lower receiver having an illustrative bolt catch shown thereabove, and an upper receiver.

FIG. 1 is a schematic exploded view of a two-piece receiver 1, it being possible, in the lower receiver 11, for a magazine (not shown) to be received in a magazine well 13 provided for this purpose. Furthermore, a magazine release aperture 141 is shown in the lower receiver 11, in which a magazine release 14 can be installed in a known manner. Above the magazine release aperture 141, the bolt catch receptacle 151 for the bolt catch 15 as well as protrusions that are formed to project laterally from the lower receiver 11 for receiving a pivot pin 17 can be seen. Said pivot pin is inserted into the protrusions in the barrel direction 51 along the pivot axis 21 in order to fix the bolt catch 15 such that it can be deflected within limits.

Furthermore, it can be seen in FIG. 1 that the first bolt catch lever 2 comprises a recess having an undercut in order to receive a second bolt catch lever 3 by sliding in along an insertion axis 37 if necessary.

Figures 3A, 3B:
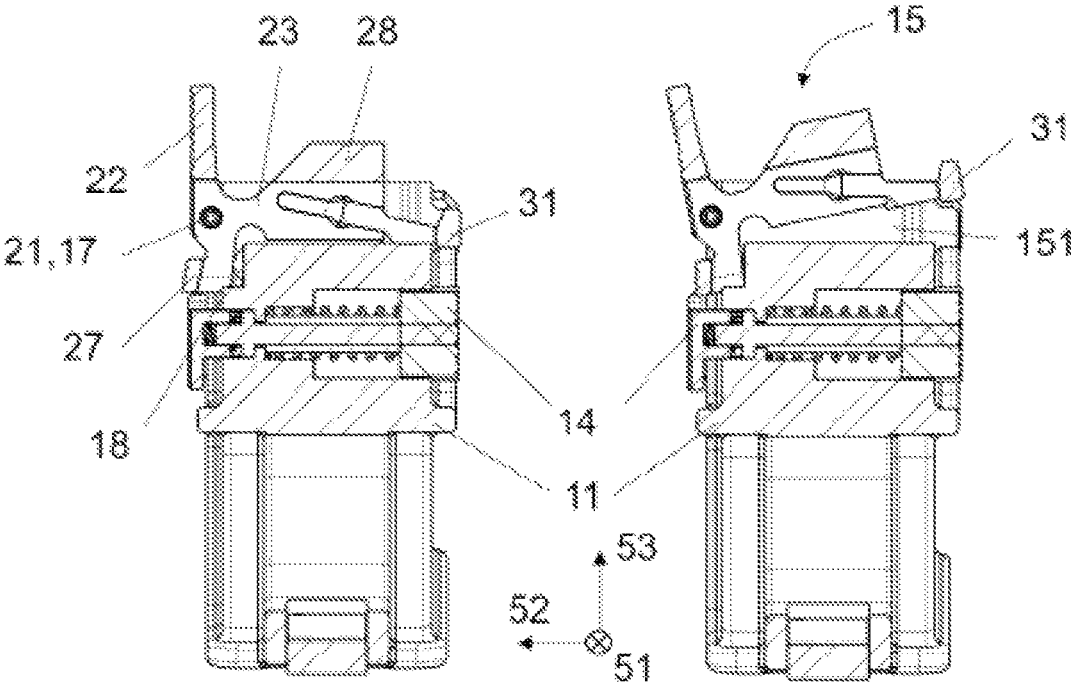
FIG. 3A is a cross section along the line III-III' of FIG. 2, with the illustrative bolt catch in the idle position.
FIG. 3B shows the analogous cross section with the illustrative bolt catch in the active position.
Figure 4A:
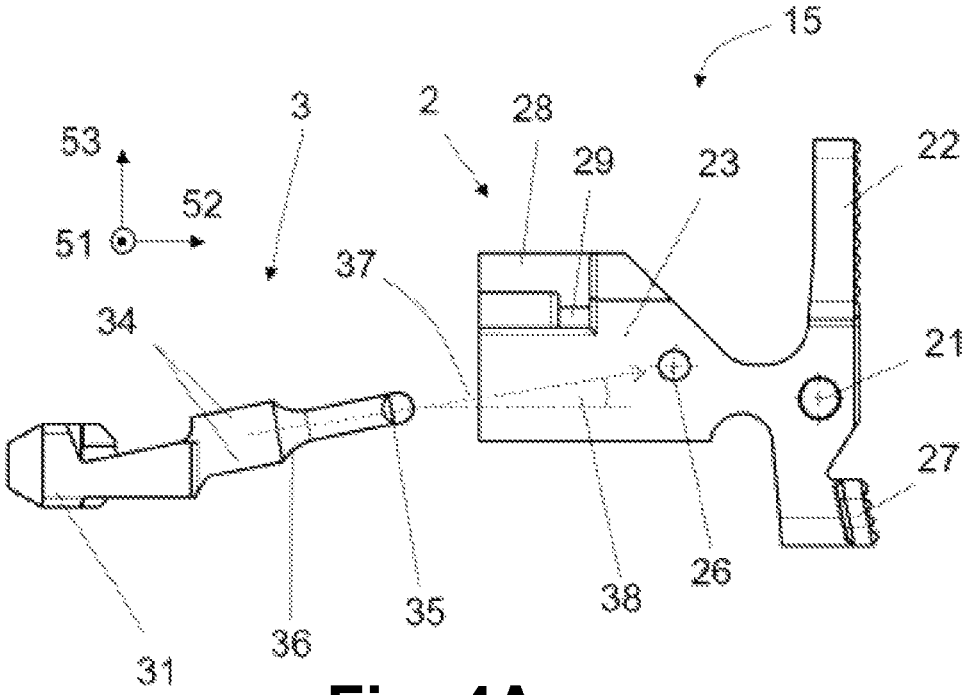
FIG. 4A is a schematic exploded view of an illustrative bolt catch in a "front" view.
Figure 4B:
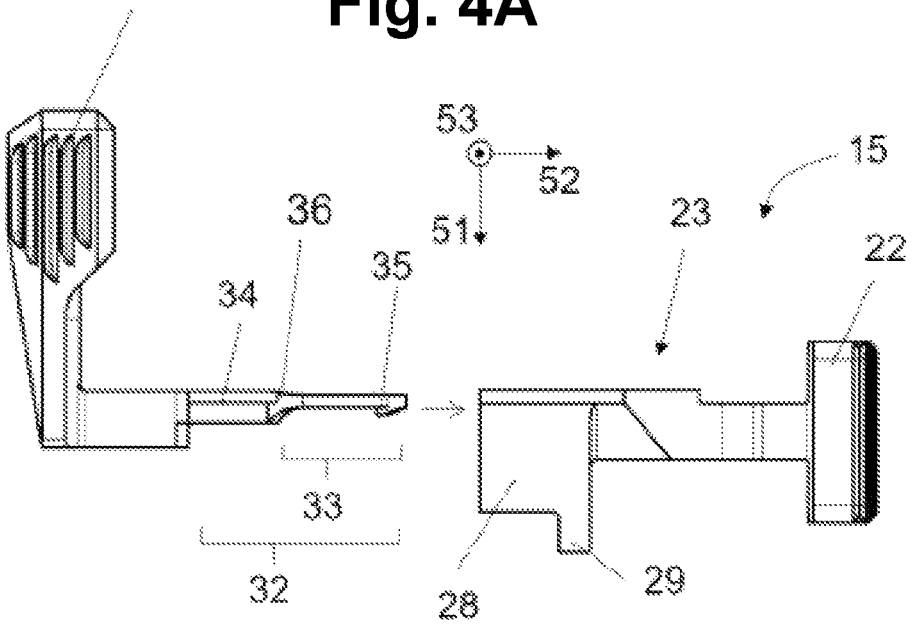
FIG. 4B is the schematic exploded view of the illustrative bolt catch in a corresponding plan view.

When installed, the first bolt catch lever 2 projects from the receiver 1 to the left at least in part in the transverse direction 52, as is clear when viewed together with FIGS. 3A and 3B. FIG. 1 also shows an expedient measure according to the invention for protecting against unintended actuation and/or snagging on the first bolt catch lever 2, or the upper and/or lower lever arm 22 or 27 thereof, in the form of a bolt catch curb 152. This curb 152 is designed to project opposite the upper receiver 12 and thus forms, when installed, a kind of lateral limit stop of the upper lever arm 22. The bolt catch curb may be configured to surround at least a portion of the upper lever arm of the first bolt catch lever when the bolt catch lever is in the installed position.

In a preferred variant, this bolt catch curb 152 is designed to project relative to the upper receiver 12 at the same level as the upper lever arm 22 projects relative to the upper receiver 12 in the idle position (cf. FIG. 3A). In other words, these two elements 152 and 22 are at substantially the same level relative to the upper receiver 12.

In another, particularly preferred variant, the curb 152 has a substantially "H shape," which means that the curb 152 can not only be designed to protect the upper lever arm 22 downwards in the vertical direction 53, but also to protect said arm upwards, as a result of which a protected region is produced. This region can, for example, be used to apply a number, such as a registration code, a weapon number, or a logo, and is largely protected against mechanical wear by the curb.

Figure 2:
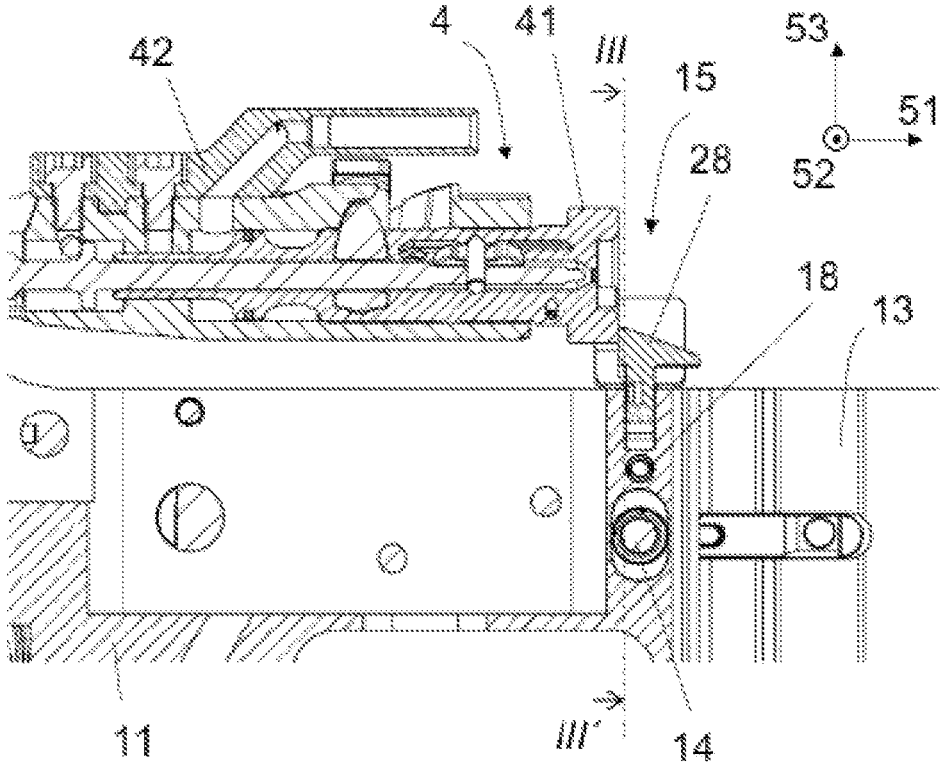
FIG. 2 shows a detail of a sectional view through the central plane of an illustrative firearm, including a bolt that is retained by an exemplary bolt catch.

The operating principle of the bolt catch 15 is shown schematically in FIG. 2, a section through the central weapon plane, a detail with a bolt carrier 4 being shown. During advancing by the bolt catch 15 or the catch 28 thereof, the bolt carrier 4 is blocked against the bolt head 41 in a known manner. A gas key 42, which is only shown for the sake of orientation, can also be seen on the bolt carrier 4.

When FIG. 2 is considered more closely together with FIGS. 3A and 3B, it is clear that the bolt catch 15 according to the invention only requires one pivot axis 21 and is held in its idle position (FIG. 3A) by means of a biasing element 18. If the lower lever arm 27 is then manually actuated on the first bolt catch lever 2 or the second lever arm 31 is manually deflected upwards, or the previously described deflection of the bolt catch finger 29 (FIG. 5A) on the catch 28 is carried out by the follower of a magazine after the last cartridge, the first bolt catch lever 2 is tilted about the pivot axis 21 into the active position (FIG. 3B) counter to the preload force of the biasing element 18. When FIGS. 3A and 3B are considered more closely, it can be seen that the tilting is limited by the stop of the lower lever arm 27 on the lower receiver 12.

There is a wide range of options for designing the bolt catch 15 according to the invention, some of which are explained here by way of example and in particular with reference to an overview of FIGS. 4A-7C. As can be seen in FIGS. 4A, 4B, 5A and 5B, the first and second bolt catch levers 2, 3 are coordinated with one another such that a form-fitting connection is possible. Here, the center element 23 of the first bolt catch lever 2 comprises a recess 24, which is preferably designed to be open towards the rear at least in part. This recess 24 is in form of a groove and comprises an undercut. The shape of the undercut is adapted to the shape of the corresponding connection section 32 and may e.g. be in the shape of a dovetail profile, L-shaped, or T-shaped. The second bolt catch lever 3, provided for insertion into the center element 23, comprises an accordingly form-complementary connection section 32 in order to form a form-fitting connection, at least in the region of the recess 24, after insertion into the first bolt catch lever 2. This connection is preferably detachable, i.e. coupleable, which makes it possible to easily revert from a bolt catch 15 that can be operated ambidextrously to a bolt catch that can be operated from one side.

As can be clearly seen from viewing FIGS. 4A-6B together, it is possible to form at least one step 34 to project laterally on the connection section 32, which step engages in the undercut of the recess 24. The design of the connection section 32 is similar to the above-described design of the recess 24. In this way, the second bolt catch lever 3 can be prevented from twisting about the vertical direction 53 or also about the insertion axis 37, and the risk of jamming of the bolt catch 15 in the bolt catch receptacle 151 can be reduced.

Figure 5A:
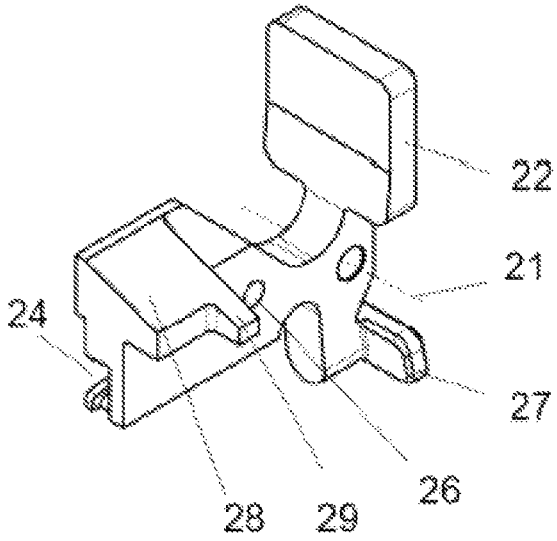
FIG. 5A is an oblique "front" view of another illustrative bolt catch lever.
Figure 5B:
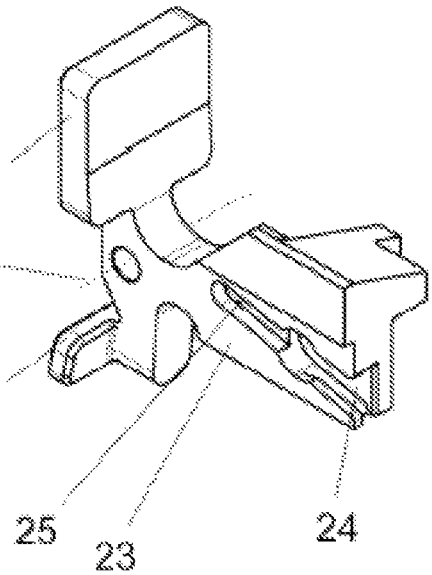
FIG. 5B is an oblique "rear" view of the illustrative bolt catch lever.
Figure 6A:
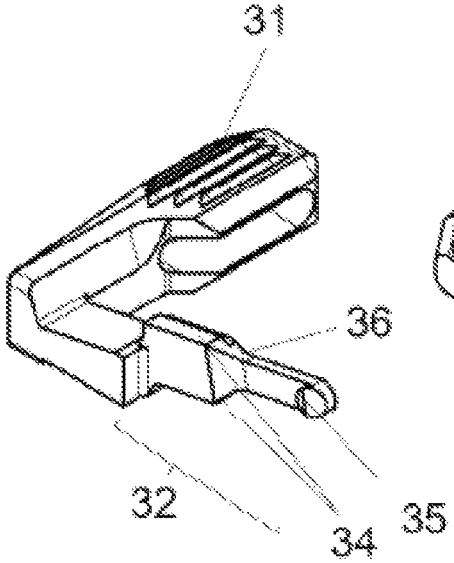
FIG. 6A is an oblique "front" view of an alternative illustrative bolt catch lever.
Figure 6B:
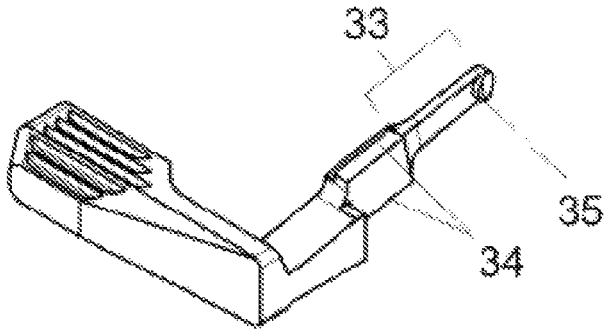
FIG. 6B is an oblique "rear" view the alternative illustrative bolt catch lever.

FIGS. 5A, 5B, 6A, and 6B show a first bolt catch lever 2 and a second bolt catch lever 3, respectively, in oblique front views (FIGS. 5A, 6A and 6B) and oblique rear views (FIG. 5B). It is clearly visible that the first bolt catch lever 2, as is standard in the prior art, comprises a larger upper lever arm 22 and a slightly smaller lower lever arm 27. The common pivot axis 21 is usually designed as a through-hole and can receive a pivot pin 17, or a tension spring or the like. A catch 28, which blocks the forward movement of the bolt carrier 4 when the first bolt catch lever 2 tilts upwards, is formed on the center element 23 in the forward direction, i.e. in the barrel direction 51 when installed (cf. FIG. 2). A bolt catch finger 29 which interacts with the follower of the magazine in a known manner is formed on the catch 28.

Another preferred embodiment can be seen in FIGS. 5A and 5B, according to which the recess 24 comprises a latch 25 which serves to support a pawl 35 of the second bolt catch lever 3. As can be seen from FIGS. 6*a* and *b*, it is advantageous for the connection section 32 to comprise a somewhat recessed end section 33. This end section 33 may have a lower material thickness in at least one spatial direction than in the transition region of the connection section 32 to the lever arm 31 and also does not have to comprise a step 34, meaning that elastic deformation and/or deflection of the end section 33 relative to the insertion axis 37 is made possible. The end section 33 may comprise a pawl 35, which can snap or latch into a latch 25 in a reversible, or detachable, coupling. It can also be seen in FIG. 4A that the transition to the end section 33 is designed to be seamless in the form of a taper 36, thus improving the mechanical stability of the bolt catch 15.

FIGS. 7A-7C schematically show some possible embodiments of first bolt catch levers 2, all of which comprise a recess 24. It can be determined that the three variants have different directions or insertion angles 38 of the insertion axis 37 relative to the lower edge of the center element 23. It is possible in principle for the insertion axis 37 to extend in parallel with the lower edge of the center element 23, which corresponds to an insertion angle 38 of 0°. It is also possible to provide a very steep insertion angle 38 of up to 60°, meaning that the arrangement of the coupling point between the latch 25 and the pawl 35 may be more easily accessible from above in some circumstances. It has, however, proved advantageous for the insertion axis 37 of the second bolt catch lever 3 to be formed at an insertion angle 38 of from 5° to 45°, preferably from 10° to 30°, relative to the lower edge of the first bolt catch lever 2 or its center element 23 when viewed in transverse direction 52 when installed.

When viewing FIGS. 3A, 3B and 4A, 4B together, it is clear that, depending on the desired position of the second lever arm 31 projecting from the receiver 1 on the right side, the shape of the second bolt catch lever 3 and/or the insertion angle 37 can be optimally coordinated with one another. In addition, the positioning of the releasable connection, in particular the latching connection, can also be accordingly selected in order to make said connection accessible without disassembling the first bolt catch lever 2.

In a variant shown by way of example, the second lever arm 31 is angled (see FIG. 4B) and bent (FIG. 4A) in at least one spatial direction relative to the insertion axis 37 of the first bolt catch lever 2. The angled section of the second lever arm 31 points backwards when installed, while the section of the second lever arm 31 that is bent downwards relative to the insertion axis in the vertical direction 53 is designed to be connected to the connection section 32, as is very clearly visible when viewing FIGS. 6A, 6B and FIGS. 4A, 4B together. It is thus easily possible for a person skilled in the art to optimally configure the position and shape of the second lever arm 31 in the vertical direction 53 and/or barrel direction 51 according to the geometric requirements of the weapon, without impairing the function of the bolt catch 15. This may serve to make it easier for the shooter to reach the right-sided second lever arm 31.

It may likewise be advantageous for the bend and/or angling of the second bolt catch lever 3, or the second lever arm 31 thereof, to be provided relative to the insertion axis 37 in order to prevent the second bolt catch lever 3 from striking the upper receiver 12 in the active position. This interrelationship is very clearly visible in FIG. 3B when viewed together with FIG. 8, wherein the upper edge of the lower receiver 11 coincides with the lower edge of the upper receiver 12 when installed and the bolt catch 15 can pivot upwards without obstruction until the left-hand, lower lever arm 27 strikes the receiver 1.

In some embodiments, as shown in FIG. 7A, it is provided that the recess 24 is also open towards the rear on the center element 23 continuously in the direction of the pivot axis 21. The position of the latch 25 is clear from the associated oblique view. This embodiment is simple to manufacture and the pawl 35 is easily accessible from the outside for decoupling.

The exemplary variants in FIGS. 7B and 7C comprise a latch hole 26 instead of an indentation for forming the latch 25, as is also very clearly visible in the example in FIGS. 5A and 5B. A latch hole 26 of this kind on the end of the recess 24 closest to the pivot axis 21 is designed to penetrate the center element 23 in the barrel direction 51. This is advantageous in that the center element 23 has a mechanically stable support region, despite the recess 24 being made therein, and at the same time the latch element 35 can be released by being actuated from the front through the latch hole 26.

Furthermore, the different angular position of the insertion axis 37 relative to the lower edge of the center element 23 is clearly visible in FIGS. 7B and 7C. The above-described options for optimizing the position of the second lever arm 31 are applicable.

As explained at the outset, another problem addressed by the invention is to reduce the risk of penetration of foreign bodies into the receiver as far as possible. If a lower receiver 11 of an existing rifle is then adapted for the use of a bolt catch 15 according to the invention, only one hole needs to be made to the right in the transverse direction 52 for the bolt catch receptacle 151. It is easily conceivable that, when only the first bolt catch lever 2 is used, this hole remains and thus promotes the penetration of foreign bodies.

This problem can be solved in several ways, which can be used on their own or in combination. As shown in FIGS. 8A-8C, it is possible to use an upper receiver 12 which comprises a cover protrusion 16 on its inner face in the region of the bolt catch receptacle 151. This cover protrusion 16 is designed to project far enough into the interior of the upper receiver 12 that it does not prevent the movement of the bolt carrier 4 or the first bolt catch lever 2. Furthermore, the cartridges should also be prevented from coming into contact with a full magazine. This situation is clearly visible in FIG. 8B, which, when viewed together with FIG. 3B, shows that the bolt catch 15 can pivot to the left into the active position without obstruction, but the cover protrusion 16 clearly minimizes the gap between the upper receiver 12 and the center element 23 or catch 28 of the first bolt catch lever 2 in the idle position of the bolt catch 15. In this way, any penetration of foreign bodies can be efficiently reduced.

In a particular embodiment, a plug 153 is provided which serves to temporarily close the right-sided hole in the bolt catch receptacle 151. As can be clearly seen from FIG. 9, it is thus possible to close the bolt catch receptacle 151 on the right-hand side when only the first bolt catch lever 2 is being used.

Particularly preferably, the bolt catch receptacle 151 is formed on the right-hand side in the end region to receive the plug 153 and to reduce the risk of falling out unintentionally.

As shown in FIG. 9, this can e.g. be carried out by means of fixation recesses 154, into which the plug 153 can be "inserted" or "introduced." In the example shown, the plug 153 is designed such that it can be inserted into the lower receiver 11 or the corresponding fixation recesses 154 from above. Once the plug 153 has been mounted in the weapon, it is thus possible to improve the sealing of the receiver 1 even though a bolt catch 15 that can be operated from one side is being used.

Such a plug 153 may be made of metal or, preferably, of an elastically deformable polymer, which particularly promotes the sealing.

Owing to the relatively small dimensions of the second bolt catch lever 3 and/or the plug 153, said components can be "temporarily stored" in a recess, provided for this purpose, in the receiver 1 or also in a stock or grip (not shown). Here, the recess in the receiver may likewise have a shape like the lateral hole region of the bolt catch receptacle 151 comprising fixation recesses 154, in order to receive the plug 153, for example. It is likewise possible to provide that the recess has a shape that is similar to the recess 24 of the first bolt catch lever 2, in order to temporarily receive the second bolt catch lever 3. In this way, the weapon can be relatively rapidly adapted from an ambidextrous to a single-sided bolt catch 15, or vice versa, since the required components always remain about the shooter's person or on the rifle. In addition, such mounting reduces rattling.

It is clear to a person skilled in the art that the embodiments shown have been selected as schematic and/or exemplary views, and it is possible for a person skilled in the art to also transfer the interrelationships according to the invention to embodiments that are not explicitly shown without any difficulty, which is why these implicitly disclosed embodiments can be inherently inferred both in the description of the figures and in the claims.

A number of additional aspects and features of the disclosed bolt catch lever are presented here without limitation as a series of paragraphs, some or all of which may be alphanumerically designated for clarity and efficiency. Each of these paragraphs can be combined with one or more other paragraphs, and/or with disclosure from elsewhere in this application, in any suitable manner. Some of the paragraphs below expressly refer to and further limit other paragraphs, providing without limitation examples of some of the suitable combinations.

A1. Bolt catch for a gun, comprising a first bolt catch lever (2) and a biasing element (18), characterized in that the first bolt catch lever (2) comprises a center element (23) comprising an undercut recess (24) for optionally receiving a connection section (32) of a second bolt catch lever (3).

A2. Bolt catch according to paragraph A1, characterized in that the second bolt catch lever (3) comprises a connection section (32) that is designed to be connectable, preferably coupleable, to the recess (24) of the first bolt catch lever (2) in a form-fitting manner.

A3. Bolt catch according to paragraph A2, characterized in that the form-fitting connection of the first and second bolt catch lever (2, 3) is designed as a coupleable latching connection (25, 35).

A4. Bolt catch according to paragraph A2, characterized in that the connection section (32) comprises an end section (33) having a pawl (35) in order to interact with a latch (25) formed on and/or in the recess (24).

A5. Bolt catch according to any of the preceding paragraphs, characterized in that the first bolt catch lever (2) comprises a latch hole (26) that is continuous in the barrel direction (51) for latching the pawl (35) of the end section (33).

A6. Bolt catch according to paragraph A4, characterized in that the latch hole (26) is formed on the end of the recess (24) closest to the pivot axis (21).

A7. Bolt catch according to any of paragraphs A2 to A6, characterized in that the second bolt catch lever (3) comprises a lever arm (31) that is angled and/or bent in at least one spatial direction relative to an insertion axis (37) of the first bolt catch lever (2).

A8. Bolt catch according to any of paragraphs A2 to A7, characterized in that the insertion axis (37) of the second bolt catch lever (3) is formed at an insertion angle (38) of from 0° to 60°, preferably from 5° to 45°, particularly preferably from 10° to 30°, relative to a lower edge of the first bolt catch lever (2) when viewed in the transverse direction (52) when installed.

A9. Bolt catch according to any of paragraphs A2 to A8, characterized in that a step (34) is formed at least on one side of the connection section (32).

B1. Receiver (1), comprising a lower receiver (11) for receiving a bolt catch (15) according to any of claims 1 to 9, characterized in that the lower receiver (11) comprises a bolt catch receptacle (151) that is continuous in the transverse direction (52).

B2. Receiver (1), comprising a lower receiver (11) according to paragraph B1, characterized in that a right-sided hole in the bolt catch receptacle (151) is designed for temporarily receiving a plug (153) for closing the bolt catch receptacle (151), preferably comprising a recess (154) that is complementary to the plug (153) in terms of form.

B3. Receiver (1), comprising a lower receiver (11) for receiving a bolt catch (15) according to any of paragraphs A1 to A9, and/or comprising a lower receiver (11) designed according to any of paragraphs B1 to B2, characterized in that an upper receiver (12) comprises a cover protrusion (16) on its inner face in the region of the bolt catch receptacle (151).

B4. Receiver (1), comprising a lower receiver (11) for receiving a bolt catch (15) according to any of paragraphs A1 to A9, and/or comprising a lower receiver (11) designed according to any of paragraphs B2 to B3, characterized in that a bolt catch curb (152) which surrounds an upper lever arm (22) of the first bolt catch lever (2) at least in part in the installed position is formed on the upper receiver (12).

B5 Receiver (1) according to paragraph B4, characterized in that the height of the bolt catch curb (152) is substantially identical to the level of the upper lever arm (22) relative to the upper receiver (12).

B6. Receiver (1) according to paragraphs B4 or B5, characterized in that the bolt catch curb (152) is substantially H-shaped.

B7. Plug (153), designed for temporarily closing the right-sided hole in the bolt catch receptacle (151) according to paragraph B1 or B2.

C1. Gun, comprising a receiver (1), a grip and/or a stock, characterized in that it comprises a recess for receiving a second bolt catch lever (3) and/or a plug (153).

C2. Gun according to paragraph C1, characterized in that the recess is substantially in the shape of the recess (24) and/or the right-sided hole in the bolt catch receptacle (151), preferably comprising fixation recesses (154), for receiving the second bolt catch lever (3) and/or a plug (153).

The invention is not limited to the embodiments that are shown and discussed, but can be modified and configured in several ways. Therefore, it is in particular possible to carry out the adaptation to the envisaged weapon within wide limits with knowledge of the invention, and combinations of individual design features can also be provided; as an example, just the option of combining the "continuous" design of the recess 24 corresponding to FIG. 7A with a latch hole according to FIG. 7C shall be mentioned.

It should also be noted that, in the description and the claims, statements such as "lower region" of an object mean the lower half and in particular the lower quarter of the total height, "lowermost region" means the lowermost quarter and in particular an even smaller part, while "central region" means the central third of the total height (width-length). All of these statements have a generally accepted meaning, which is applied to the intended position of the object in question, and they apply equally to "rear region," etc.

In the description and the claims, "substantially" means a deviation of up to 10% of the stated value, if it is physically possible, both down and up, and otherwise only in the relevant direction, and for stated degree values (angles and temperature), ±10° is thus meant.

Unless stated otherwise, the term "combination" or "combinations" means all types of combinations, ranging from two of the components in question through to a large number of or all such components, and the term "containing" also covers "consisting of."

The features and variants set out in the individual embodiments and examples can be combined with those of the other examples and embodiments in any manner, and can in particular be used for characterizing the invention in the claims without necessarily also incorporating the other details of the embodiment or example in question.

| Listing of Reference Numerals | |
|---|---|
| 1 | Receiver |
| 11 | Lower receiver |
| 12 | Upper receiver |
| 13 | Magazine well |
| 14 | Magazine release |
| 141 | Magazine release aperture |
| 15 | Bolt catch |
| 151 | Bolt catch receptacle |
| 152 | Bolt catch curb |
| 153 | Plug |
| 154 | Fixation recess |
| 16 | Cover protrusion |
| 17 | Pivot pin |
| 18 | Biasing element |
| 2 | First bolt catch lever |
| 21 | Pivot axis |
| 22 | Upper lever arm |
| 23 | Center element |
| 24 | Recess |
| 25 | Latch |
| 26 | Latch hole |
| 27 | Lower lever arm |
| 28 | Catch |
| 29 | Bolt catch finger |
| 3 | Second bolt catch lever |
| 31 | Second lever arm |
| 32 | Connection section |
| 33 | End section |
| 34 | Step |
| 35 | Pawl |
| 36 | Taper |
| 37 | Insertion axis |
| 38 | Insertion angle |
| 4 | Bolt carrier |
| 41 | Bolt head |

-continued

| Listing of Reference Numerals | |
|---|---|
| 42 | Gas key |
| 51 | Barrel direction |
| 52 | Transverse direction |
| 53 | Vertical direction |

What is claimed is:

1. A bolt catch for a firearm, comprising:

a first bolt catch lever having a center element defining an undercut recess configured to optionally receive a connection section of a second bolt catch lever; and a biasing element configured to urge the first bolt catch lever into an idle position.

2. The bolt catch according to claim 1, wherein the connection section of the second bolt catch lever couples with the undercut recess defined by the first bolt catch lever in a form-fitting manner.

3. The bolt catch according to claim 1, wherein the undercut recess of the first bolt catch lever is configured to receive the connection section of the second bolt catch lever when it slides into the undercut recess along an insertion axis.

4. The bolt catch according to claim 2, wherein the form-fitting coupling of the first and second bolt catch levers is a reversible latching connection.

5. The bolt catch according to claim 2, wherein the connection section of the second bolt catch lever includes an end section having a pawl configured to interact with a latch defined on and/or in the undercut recess of the first bolt catch lever.

6. The bolt catch according to claim 5, wherein the first bolt catch lever further defines a latch hole extending in a direction parallel to a barrel of the firearm, the latch hole being configured to latch with the pawl of the end section of the second bolt catch lever.

7. The bolt catch according to claim 6, wherein the latch hole is defined at an end of the undercut recess that is closest to a pivot axis of the first bolt catch lever.

8. The bolt catch according to claim 3, wherein the second bolt catch lever includes a lever arm that is angled and/or bent so as to extend in at least one spatial direction relative to the insertion axis.

9. The bolt catch according to claim 8, wherein the insertion axis forms an insertion angle of from 0° to 60° relative to a lower edge of the first bolt catch lever when viewed in a transverse direction when installed.

10. The bolt catch according to claim 8, wherein the insertion axis forms an insertion angle of from 5° to 45° relative to a lower edge of the first bolt catch lever when viewed in a transverse direction when installed.

11. The bolt catch according to claim 8, wherein the insertion axis forms an insertion angle of from 10° to 30° relative to a lower edge of the first bolt catch lever when viewed in a transverse direction when installed.

12. The bolt catch according to claim 2, wherein a step (34) is formed on at least one side of the connection section of the second bolt catch lever.

13. A receiver for a firearm, comprising a lower receiver that is configured to receive a bolt catch that includes:

a first bolt catch lever having a center element defining an undercut recess configured to optionally receive a connection section of a second bolt catch lever; and a biasing element configured to urge the first bolt catch lever into an idle position;

provided that the lower receiver defines a bolt catch receptacle that is continuous in a transverse direction.

14. The receiver according to claim 13, wherein the bolt catch receptacle includes a right-side opening configured to temporarily receive a plug to close the bolt catch receptacle at a right side of the firearm.

15. The receiver according to claim 14, wherein the right-side opening includes a recess that is complementary to the plug in terms of form.

16. The receiver according to claim 13, further comprising an upper receiver that includes a cover protrusion on an inner face of the upper receiver in a region of the bolt catch receptacle.

17. The receiver according to claim 13, further comprising an upper receiver that includes a bolt catch curb configured to surround at least a portion of an upper lever arm of the first bolt catch lever when the bolt catch lever is in an installed position.

18. The receiver according to claim 17, wherein the bolt catch curb has a height that is substantially identical to a level of the upper lever arm relative to the upper receiver.

19. The receiver according to claim 17, wherein the bolt catch curb is substantially H-shaped.

20. A plug that is configured to temporarily close a right-side opening of the bolt catch receptable of claim 13.

* * * * *